United States Patent [19]

Puchalska-Hibner

[11] 4,144,585

[45] Mar. 13, 1979

[54] BUBBLE DOMAIN STRUCTURES AND METHOD OF MAKING

[75] Inventor: Irena Puchalska-Hibner, Orsay, France

[73] Assignee: The United States of America as represented by the Secretary of the Air Force, Washington, D.C.

[21] Appl. No.: 714,546

[22] Filed: Aug. 16, 1976

Related U.S. Application Data

[63] Continuation of Ser. No. 452,590, Mar. 19, 1974, abandoned.

[51] Int. Cl.[2] ..... H01F 10/02

[52] U.S. Cl. ..... 365/3; 365/30; 365/33; 427/47; 427/128; 427/132; 427/250; 427/294; 428/900

[58] Field of Search ..... 427/127-132, 427/48, 47, 250, 294; 428/900; 365/30, 33, 3

[56] References Cited

FOREIGN PATENT DOCUMENTS 1106710 3/1968 United Kingdom.

OTHER PUBLICATIONS

Williams et al., J of AP, vol. 28, No. 5, May 1957, 427-448, pp. 548-555 *Mag. Domain Patterns on this Films.*

Sugita et al., J. Phys Sec. Japan, vol. 19, (1964) 782, *Stripe Magnetic Domain . . . in from Films.*

*Primary Examiner*—Bernard D. Pianalto

*Attorney, Agent, or Firm*—Joseph E. Rusz; Robert Kern Duncan

[57] ABSTRACT

A magnetic bubble domain structure and method of making comprising a film of a nickel-iron alloy of 80 to 83.5% nickel content and substantially zero constant of magnetostriction formed by vapor deposition of the alloy onto a flat substrate at a substrate temperature in the range of room temperature to 200° C. at an angle of incidence of approximately 60° to a film thickness of 0.2μm to 3.0μm, the film being immersed in a magnetic field perpendicular to the film and of 1600 to 2400 oersteds intensity.

4 Claims, No Drawings

BUBBLE DOMAIN STRUCTURES AND METHOD OF MAKING

The invention described herein may be manufactured and used by or for the Government of the United States for all governmental purposes without the payment of any royalty.

This is a continuation of application Ser. No. 452,590, filed Mar. 19, 1974 and now abandoned.

BUBBLE DOMAIN STRUCTURES

This invention relates to bubble domain structures in alloys of nickel and iron.

Bubble domains have already been produced in orthoferrites and garnets and have aroused some interest in view of their application as memory elements in computers. Examples of such devices are disclosed in U.S. Pat. Nos. 3,530,446, 3,540,021, and 3,602,911. However, these materials are relatively expensive.

Recent investigations of films of nickel/iron alloy which have a less complicated technology than orthoferrites and garnets have revealed that when the films are evaporated obliquely a stripe structure is produced in the film. These stripes are so called "weak" when the angle of evaporation is less than 45°, and so called "strong" when the angle of evaporation is greater than 45°.

It has now been discovered that when a magnetic field is applied to the film the strong stripes are transformed into rows of bubbles.

Accordingly the present invention provides a film of nickel/iron alloy evaporated onto a substrate at an angle of from 45° to 80°, and having bubble domains formed therein by an applied magnetic field.

The alloys which are preferably used are those which are known as 'Permalloy' and which contain for example nickel and iron in the range 80:20 to 83.5:16.5. Alloys which are particularly preferred are those having zero or substantially zero constant of magnetostriction.

Evaporation can be carried by any suitable technique for example from an aluminium oxide crucible or by electron beam bombardment.

Any suitable substrate may be employed such as glass or sodium chloride crystal. The substrate may, if desired, be heated since this will produce wider strong stripes. Generally it is preferred not to heat the substrate much above 200° C.

The thickness of the film is preferably from 0.2 μm to 3.0 μm. Up to a thickness of about 0.35 μm it is found that the strong stripe width increases with thickness but at thicknesses greater than 0.35 μm there is no significant increase in stripe width.

The nature of the bubble domains formed in the film is dependent, inter alia, on the strength and direction of the applied field. The inventor has found that bubble domains can be produced in a magnetic field applied either perpendicularly to the major plane of the film or parallel thereto.

The following Examples illustrate the invention.

EXAMPLE I

An 83.2:16.8 nickel/iron alloy was evaporated from an aluminium oxide crucible onto an unheated glass substrate at an angle of evaporation of 60° and in a vacuum of between $2 \times 10^{-5}$ and $2 \times 10^{-6}$ torr to produce a film having a thickness of 2.0 μm. The film exhibited strong stripes having a width of 0.30 μm.

When a magnetic field of 1800 Oa was applied perpendicularly to the film alternate stripes formed a row of bubbles, each bubble having a diameter of from 0.25 to 0.35 μm.

EXAMPLES 2–7

Films were prepared in accordance with the same techniques as described in Example 1 but using different alloy compositions and varying the thickness of the film, temperature of the substrate and strength of the applied field. The results are shown in the following Table.

TABLE

| Ex. | Angle of Evaporation | Composition (Ni - Fe) | Thickness (μm) | Substrate Temperature (° C) |
|---|---|---|---|---|
| 2 | 60 | 82.0–18.0 | 0.65 | Room |
| 3 | 60 | 80.5–19.5 | 0.5 | Room |
| 4 | 60 | 83.5–16.5 | 1.5 | 200° |
| 5 | 60 | 83.2–16.8 | 0.5 | 200° |
| 6 | 45 | 83.2–16.8 | 0.7 | Room |
| 7 | 45 | 82.0–18.0 | 1.0 | Room |

| Ex. | Kind of Stripes | Stripe Width (μm) | External Field (Oe) | Bubble Diameter μm) |
|---|---|---|---|---|
| 2 | Strong | 0.39 | 1800 | 0.50–0.80 |
| 3 | Strong | 0.30 | 2400 | 0.30–0.35 |
| 4 | Strong | 0.50 | 1600 | 0.50–0.80 |
| 5 | Strong | 0.36 | 1600 | 0.36–0.38 |
| 6 | Weak | 0.30 | 2000 | 0.40–0.50 |
| 7 | Weak + | 0.50 | 2000 | 0.50–0.70 |
| | Strong | 0.50 | | |

EXAMPLE 8

An 82:18 nickel/iron alloy was evaporated at an angle of between 65° and 70° to form a film of 0.5 μm thickness on an unheated glass substrate. Instead of continuous strong stripes a mosaic structure of strong stripes of width 0.34 μm was observed in the film. The angle between stripe fragments was 120° and they were found to lie at an angle of 30° to the projection of the vapour beam.

On applying a perpendicular magnetic field of 2700 Oe a lattice arrangement of bubbles was formed from alternate stripes, the bubbles having a diameter of from 0.50 μm to 0.54 μm.

EXAMPLE 9

The procedure described in Example 8 was repeated except that the alloy was 83.2:16.8 nickel/iron and the film thickness was 0.3 μm. A mosaic of strong stripes was again observed, the width thereof being 0.30 μm. On applying a perpendicular field of 2400 Oe a lattice of bubbles was formed, the bubbles having a diameter of from 0.40 to 0.50 μm.

The foregoing examples describe specific embodiments of the invention in which a magnetic field is applied perpendicularly to the major plane of the film. As indicated previously however bubbles can be formed in the film when a magnetic field is applied parallel to the major plane of the film to saturate it and subsequently the field strength is reduced.

EXAMPLE 10

A film of 0.2 μm thickness was produced on an unheated substrate from 83:17 nickel/iron evaporated at 60°.

In a parallel field of 120 Oe along the strong stripes every alternate stripe was observed to shrink and when the field was increased to 150 Oe bubbles were formed.

When the field was further increased to 300 Oe small elongated domains with reverse magnetisation were observed.

When the field was reduced to 150 Oe again some small narrow domains were transformed into stripes and islands of bubbles were created. After a further reduction of the field to 50 Oe closepacked bubbles of diameter 1.0 to 1.3 μm were observed.

EXAMPLE 11

A field of 300 Oe was applied to the film as prepared in Example 8 parallel to the major plane of the film to saturate it. The field was then reduced to −150 Oe. A lattice of bubbles having a diameter of from 0.7–1.2 μm were formed, the lattice highly ordered. This ordered array of bubbles was not observed in corresponding films made from orthoferrites and garnets where only random array could be formed.

EXAMPLE 12

A film of 0.5 μm was produced on an unheated substrate from 83.2:16.8 nickel/iron evaporated at 60°. Strong stripes of 0.35 μm width were observed in the film.

A field was applied parallel to the major plane of the film so as to saturate the film and thereafter the field was reduced to zero. After reduction of the field the stripes were found to have been transformed into bubbles having a diameter of 0.55 μm.

We claim:

1. The method of producing magnetic bubble domains comprising: forming a film of an alloy of 80 to 83.5 percent nickel and the remainder iron and substantially zero constant of magnetostriction by vapor deposition of said alloy in a vacuum of $2 \times 10^{-5}$ to $2 \times 10^{-6}$ Torr onto a flat substrate at a substrate temperature in the range of room temperature to 200° C. at an angle of incidence of approximately 60° and to a film thickness of 0.2 μm to 3.0 μm, and subjecting said film to a magnetic field perpendicular to the film of 1600 to 2400 oersteds intensity.

2. A magnetic bubble domain structure comprising: a film of an alloy of 80 to 83.5 percent nickel and the remainder iron and substantially zero constant of magnetostriction formed by vapor deposition of said alloy in a vacuum of $2 \times 10^{-5}$ to $2 \times 10^{-6}$ Torr onto a flat substrate at a substrate temperature in the range of room temperature to 200° C. at an angle of incidence of approximately 60° and to a film thickness of 0.2 μm to 3.0 μm, said film being immersed in a magnetic field perpendicular to the film of 1600 to 2400 oersteds intensity.

3. The structure of claim 2 in which said substrate is glass.

4. The structure of claim 2 in which said substrate is sodium chloride.

* * * * *